US008511924B2

(12) United States Patent
Bartolucci et al.

(10) Patent No.: US 8,511,924 B2
(45) Date of Patent: Aug. 20, 2013

(54) DISPENSING DEVICE FOR VISCOUS MATERIALS

(75) Inventors: Stefano Bartolucci, London (GB); Paulus Hoefte, St Martens Latem (BE); John David Lamb, Marlborough (GB); Paul Robert Scott, Brussels (BE); Pedro Vincent Vandecappelle, Izegem (BE)

(73) Assignee: The Procter & Gamble Company, Cincinnati, OH (US)

( * ) Notice: Subject to any disclaimer, the term of this patent is extended or adjusted under 35 U.S.C. 154(b) by 701 days.

(21) Appl. No.: 12/641,808

(22) Filed: Dec. 18, 2009

(65) Prior Publication Data

US 2010/0155431 A1 Jun. 24, 2010

(30) Foreign Application Priority Data

Dec. 23, 2008 (EP) ..... 08172863

(51) Int. Cl.
*B43M 11/06* (2006.01)

(52) U.S. Cl.
USPC ..... 401/183; 401/176; 222/389

(58) Field of Classification Search
USPC ..... 401/176, 179, 180, 181, 183, 186, 401/188 R; 222/207, 209, 213, 389
See application file for complete search history.

(56) References Cited

U.S. PATENT DOCUMENTS

| | | | | |
|---|---|---|---|---|
| 2,329,917 | A | 9/1943 | Lautmann | |
| 3,341,083 | A * | 9/1967 | Stewart | 222/209 |
| 4,330,071 | A * | 5/1982 | Ohlson | 222/207 |
| 4,437,591 | A | 3/1984 | Von Schuckmann | |
| 4,651,904 | A * | 3/1987 | Schuckmann | 222/383.1 |
| 4,865,231 | A | 9/1989 | Wiercinski | |
| 5,217,144 | A | 6/1993 | Santefort et al. | |
| 5,322,193 | A | 6/1994 | Sunderland | |
| 5,645,193 | A | 7/1997 | Gentile et al. | |
| 6,234,360 | B1 | 5/2001 | Böckmann et al. | |
| 6,364,163 | B1 | 4/2002 | Mueller | |
| 6,581,803 | B1 | 6/2003 | Yoshimoto et al. | |

FOREIGN PATENT DOCUMENTS

| | | |
|---|---|---|
| DE | 34 36 697 A1 | 6/1986 |
| WO | WO 2008/103649 A2 | 8/2008 |

OTHER PUBLICATIONS

PCT International Search Report, mailed Feb. 9, 2010, 5 Pages.

* cited by examiner

*Primary Examiner* — David Walczak

(74) *Attorney, Agent, or Firm* — John T. Dipre; Amy I. Ahn-Roll

(57) ABSTRACT

A dispenser for viscous materials has a housing with a moveable wall that divides the interior volume of the housing into a distal product chamber and a proximal pressure chamber. An outlet from the product chamber is located adjacent to the distal end of the housing and an air inlet is provided to allow air to enter the pressure chamber. Displacement of the product occurs when accumulated excess air pressure in the pressure chamber acts on the back of the movable wall. The excess air pressure is built up by a bellows assembly arranged in fluid communication with the pressure chamber. On actuation, the bellows can be reduced in volume and subsequently recover by entry of air through the inlet. The direction of force application is preferably perpendicular to the housing axis and the location of the bellows is preferably distant from the product outlet.

14 Claims, 11 Drawing Sheets

Fig. 11
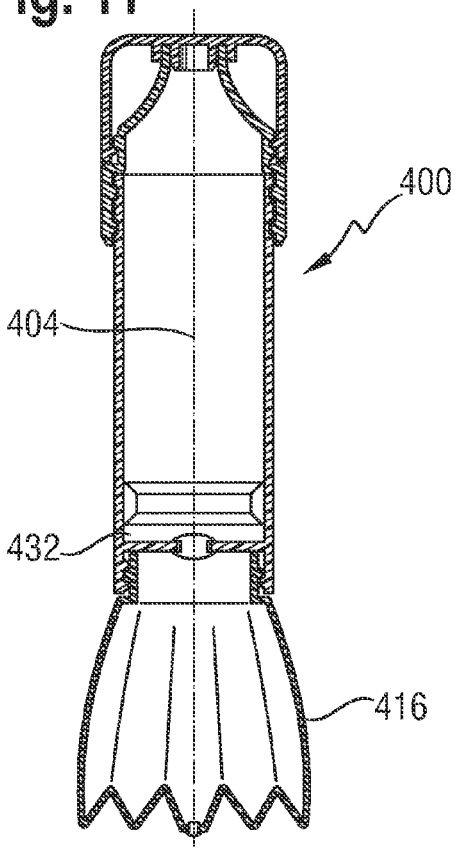
Fig. 12
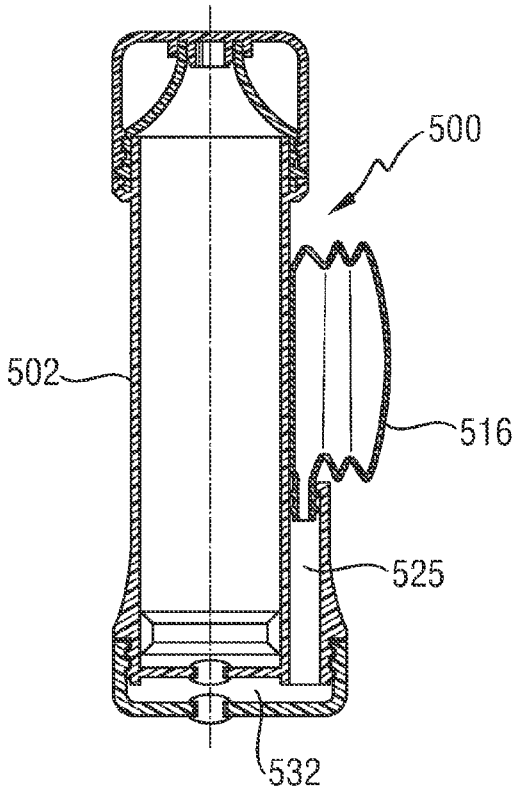
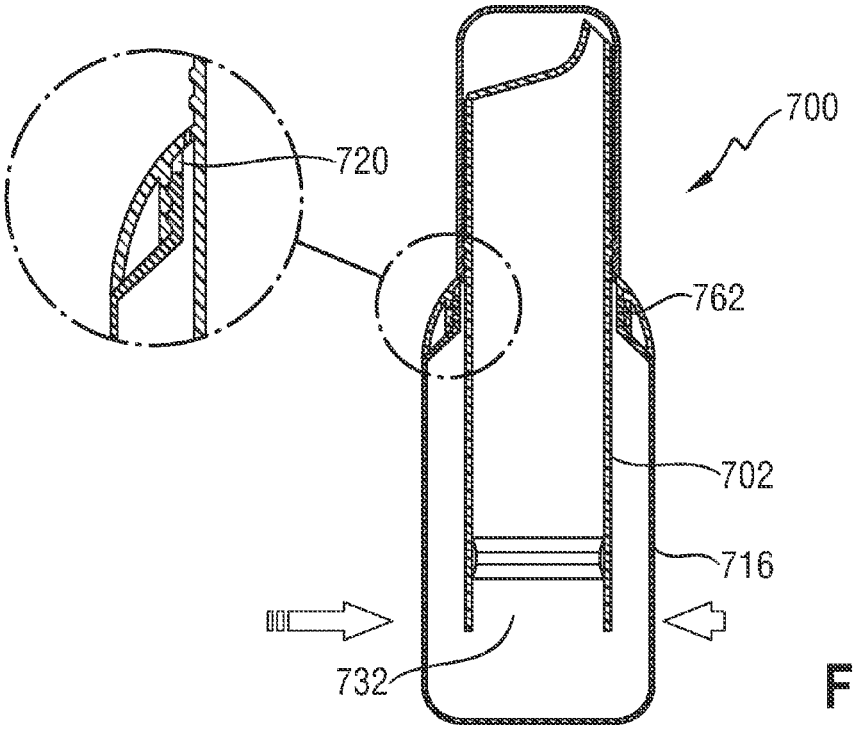
Fig. 14

816
814
803
803'
812
802
806
812'
802'
806'
860
852

814
802
802'

816
800
812
P
860
812'
P'
852

Sensitivity on bellows volume
firing speed 960 mm/min
The initial dose is always equal to the firing stroke minus a fixed amount (+/- 5 ml in this case).
Dose Volume (ml)
Dose Event (#)
10 ml
20 ml
30 ml
Dose (ml) = -2.29*Dose No. +26.69
Dose (ml) = -0.75*Dose No. +13.52
Dose (ml) = -0.28*Dose No. + 5.57

DISPENSING DEVICE FOR VISCOUS MATERIALS

FIELD OF THE INVENTION

The invention relates generally to dispensers for viscous materials and more particularly to hand operated dispensers for viscous fluids, pastes, creams and gels. Such dispensers are particularly useful in the delivery of household, fabric care, hair-care, beauty care, oral-care, do-it-yourself (DIY) and food products.

DESCRIPTION OF THE RELATED ART

A wide variety of dispensers are presently known and used. These may conveniently be divided into pressurized and unpressurised systems. Pressurized systems include aerosols and systems based on elastically biased reservoirs. These systems generally require a release button and valve to permit delivery of the pressurized product through a fluid outlet. The release button is frequently located adjacent to the outlet and can lead to the user's hand coming into contact with the product. In certain cases, the fact that the product is permanently pressurized can lead to undesired consequences. These may include uncontrolled release due to failure of the valve, accidental actuation and oozing of the product from the outlet after actuation.

Unpressurised systems generally require the energy of a user in order for delivery to occur. Examples of containers falling in this category are collapsible metal or plastic tubes such as tooth-paste tubes. These packages are affected by several problems: one is the backward flow of the remaining content of the tube, another is that it is difficult to expel entirely the content of the tube. Because of these inherent difficulties, external squeeze arrangements have been envisaged and other types of implement have been devised as shown in U.S. Pat. Nos. 5,217,144 and 5,322,193. More complex arrangements for dispensing toothpaste and the like are known in which a piston is moved on a rod by a ratchet mechanism. U.S. Pat. Nos. 4,437,591 and 4,865,231 describe such devices but are relatively complex in their need for numerous mechanical components which are disposed of after use.

A somewhat similar piston and rod principle is known from the caulking guns used to deliver sealant, e.g. as described in U.S. Pat. No. 5,217,144. These devices can provide relatively high-pressure for the delivery of highly viscous products and are reusable on insertion of a new sealant cartridge. Nevertheless, they offer little control over oozing at the outlet and are relatively expensive items to manufacture. They also require an elongate rod equal in length to the cartridge, which on initial use is inconvenient.

Another group of unpressurised dispensers are the pump dispensers. Such devices are frequently used for discharging perfumes, lotions and the like and use a finger operated back-fill pump at the upper end of a fill tube. Like aerosols, these devices require the user's finger to be located close to the discharge outlet which in certain situations may be undesirable. Many of these devices are also unable to operate in an inverted orientation, due to the requirement of a fill-tube extending to the bottom of the reservoir.

An alternative form of pump dispenser is known from U.S. Pat. No. 6,234,360, which describes a cylinder and piston arrangement for dispensing paste material. A bellows arrangement allows air entry behind the piston to displace the paste. The bellows is actuated by a force exerted axially at the distal end of the dispenser. This requires the user's hands to be located in the region of the dispenser outlet which may lead to inconvenience. When dispensing cleaning products e.g. for cleaning beneath the rim of a toilet pot, it is generally desirable for the user's hands to be distanced from the outlet. The construction is also relatively complex, requiring at least six separate components to be assembled.

In yet a further device known from U.S. Pat. No. 6,581,803 by Yashimoto et al., pressure may be exerted on a squeezable container to discharge its contents. On releasing the pressure, ambient air enters the container through a one way valve. The contents of the container are separated from the air by a flexible lining. The squeezing action applied to the container may be convenient for many dispensing situations but does not allow for convenient and accurate dosing of the dispensed quantity.

Thus, there is a particular need for a dispensing container that at least partially overcomes the above mentioned inconveniences and that allows relatively accurate dosing without the hand of the user being in proximity to the dispensed product.

BRIEF SUMMARY OF THE INVENTION

The present invention addresses these problems by providing a dispenser for viscous materials comprising a housing having a generally elongate axis with a distal end, a proximal end and an interior volume. A moveable wall divides the interior volume of the housing into a distal product chamber and a proximal pressure chamber in pressure communicating relation with one another. An outlet from the product chamber is located adjacent to the distal end of the housing and an air inlet is provided to allow air to enter the pressure chamber. Displacement of the product occurs when accumulated excess air pressure in the pressure chamber acts on the back of the movable wall. The excess air pressure is built up by a bellows arranged in fluid communication with the pressure chamber. On actuation, the bellows can be reduced in volume and subsequently recover by entry of air through the inlet. The direction of force application is preferably perpendicular to the housing axis i.e. having a significant component in the perpendicular direction. According to this preferred arrangement of the invention, a simple lateral squeezing action allows dispensing of a repeatable quantity of product through the outlet. The dispenser may be conveniently held in a user's hand and the bellows assembly may be located for actuation by a user's thumb, fingers or palm.

In an alternative arrangement, the invention is defined by manually engageable actuation surfaces, whereby pressure exerted between the actuation surfaces causes the reduction in volume of the bellows assembly, the actuation surfaces being located at a generally opposite extremity of the dispenser from the outlet.

In the present context, the term "bellows" is intended to encompass any suitable actuator or recoverable collapsible element or assembly of elements, that can expand and contract in volume by a substantially defined stroke e.g. between a defined starting position and a defined end position. This is thus to be distinguished from squeezable containers where e.g. the product chamber itself is squeezed by a greater or lesser degree to expel a variable quantity of product. The geometry and material composition of the bellows element should be such to allow a compression of bellows volume of preferably 50% or higher, most preferably of 70% or higher, between the expanded and compressed configuration: this ensures an efficient transfer of the actuation pressure applied to the bellows into pressure increase in the pressure chamber. Those skilled in the art understand that this is most easily achieved if the bellows collapse in the compression direction with minimal deformation in other directions. The present invention has been found to give reproducible, substantially constant dosing during the complete dispensing of the product.

The viscosity of the materials for use in the present invention is preferably comprised between 5 000 mPas and 500 000 mPas, preferably between 10 000 mPas and 200 000 mPas, more preferably between 15 000 mPas and 150 000 mPas, and most preferably between 25 000 mPas and 100 000 mPas when measured with a TA Instruments/Advanced rheometer AR 1000 at a temperature 20° C. with a gap setting of 1000 microns, and at a shear rate of 25 s−1. The skilled person will recognize the possibility of choosing appropriate dimensions for the dispenser according to the desired viscosity range e.g. length: cross-section (aspect ratio)—preferably 3.0 to 3.5, outlet size—preferably 20 to 30 $mm^2$, and will also understand that operation outside these viscosity ranges is possible with appropriate adaptation e.g. inclusion of outlet valve.

The air inlet to the pressure chamber is provided with a one-way arrangement. This allows air to enter the pressure chamber when the pressure of said chamber is lower than atmospheric but not escape during the compression of the bellows, i.e. when the pressure of said chamber exceeds the atmospheric pressure. The air inlet may be part of the bellows or be provided on any convenient part of the housing itself. It will also be understood that the air may inlet into the interior volume of the bellows or directly into the pressure chamber. Preferably, it would be desirable for such a valve to quickly open when the minimal negative pressure differential is applied across the valve. It would also be desirable for such a valve to remain open for at least half to one second after being initially opened to allow equalization of pressure to continue beyond the opening pressure differential. Most preferably, the one-way arrangement should be a conventional, flexible, resilient, low-pressure one-way valve such as a flap, umbrella, duck-bill, ball or disk valve. Alternatively, the one way arrangement may be provided by a vent on one of the actuation surfaces of the bellows arrangement that is covered by a user's finger or hand on actuation and uncovered on release.

The "bellows" may be formed of an inherently resilient material such as a deformable elastomeric material that is relatively more flexible than the remainder of the pressure chamber or housing. Most preferably the bellows should be formed with a material having positional memory. Suitable materials for the bellows include: polyethylene (PE); polypropylene (PP); thermoplastic elastomer (TPE) (e.g. Santoprene™, poly(p-phenylene oxide) (PPO), Elastolan™); liquid silicon rubber (LSR); thermoplastic urethane (TPU); Hytrel™; acrylonitrile butadiene rubber (NBR); nytril rubber; natural rubber; Delrin™; ethylene propylene diene monomer rubber (EPDM) or similar materials or mixtures or copolymers of these materials well known to persons skilled in the art. The material may alternatively be flexible, with the elastic return force provided by a spring member. The "bellows" can be industrially made via injection molding, blow-molding, thermoforming techniques and can be assembled with the container via hot overmolding techniques or mechanically connecting these using specific snap features, glues, ultrasonic welding, heat-sealing, rotary welding or other techniques known in the art.

In one preferred embodiment of the invention, the outlet is provided with a check-valve such as a duck-bill, slit or flap valve. In this manner undesirable outflow of the product can be avoided after termination of use. Preferably, such a valve should be responsive to a very low actuation pressure, adapted e.g. to the product being dispensed. Most preferably, this valve should be resilient, flexible, self-sealing and characterized by a cracking pressure from 0.1 to 10 mbar and if possible from 0.75 to 2 mbar. Suitable materials for the check-valve include: polyethylene (PE); polypropylene (PP); thermoplastic elastomer (TPE) (e.g. Santoprene™, poly(p-phenylene oxide) (PPO), Elastolan™); liquid silicon rubber (LSR); thermoplastic urethane (TPU); Hytrel™; acrylonitrile butadiene rubber (NBR); nytril rubber; natural rubber; Delrin™; ethylene propylene diene monomer rubber (EPDM) or similar materials or mixtures or copolymers of these materials well known to persons skilled in the art. The check-valve can be assembled on the dispenser housing. Preferably, the check-valve can be integrated into the dispenser housing and formed through a multi-material molding process like bi-injection, co-injection, multi-shot, insert- and over-molding.

According to a further embodiment, the housing may comprise two sections, a reservoir section comprising the product chamber and a driver section carrying the bellows assembly and at least partially comprising the pressure chamber. The two parts may be joined together during manufacture or assembly or may be sold as separate elements and joined at the point of use. The reservoir section may be disposable and may thus be replaced after use by a full reservoir. The driver section may be reusable at least for a number of times.

Preferably, the bellows is located adjacent the proximal end of the housing. In particular, the parts or surfaces of the bellows that are actuated by a user's hand or fingers are located at the proximal end of the housing. This is convenient since the fingers of the user are then distanced from contact with the dispensed product. In the context of e.g. toilet cleansing products, the user's fingers are then also distanced from the toilet bowl.

The moveable wall ensures that the product does not enter into direct contact with the bellows. This is particularly useful in the context of a two-part assembly of the dispenser, as the pressure chamber and bellows assembly may be kept free of product. It can also ensure that no air comes into contact with the product, in particular in combination with a check-valve at the outlet.

In a preferred embodiment of the invention, the housing comprises a cylinder and the moveable wall comprises a piston, axially slideable within the cylinder. Such piston-cylinder arrangements can be extremely effective in providing full evacuation of the product chamber. To achieve this, the piston should preferably have a flexible sealing edge and the cylinder should be generally smooth. In the present context it is understood that the cylinder need not be round in cross-section and any form of piston-cylinder arrangement could be employed including generally oval, rectangular, square, elliptical and triangular forms. The piston should preferably slide with relatively low frictional resistance in order to avoid pressure build up in the pressure chamber which would not be transferred to dispensed product. The skilled person will be aware of suitable materials for the piston and cylinder including plastics materials, metals, alloys, composites and glasses. To minimize the coefficient of friction, the cylinder or piston may also be coated e.g. with Teflon or similar coatings. Additionally or alternatively, in order to achieve a low coefficient of friction, the piston and the cylinder would be formed of different materials. Most preferably the cylinder is formed in polypropylene and the piston in polyethylene or a more resilient material. This arrangement allows the piston to re-shape once inserted into the cylinder and match the inner cylinder contour irregularities, thus allowing a better sealing.

In one adaptation, a plurality of cylinders and a plurality of pistons may be provided, each axially slideable within its respective cylinder. A single bellows may apply substantially equal pressure to a pressure chamber of each cylinder. Such an arrangement may be well suited to the dispensing of a number of products simultaneously in a desired ratio or consecutively. The relative quantities and/or sequence of products dispensed would depend upon the dispensing pressures of each cylinder and on their relative cross-sectional areas. The outlets could be joined or have separate nozzles to either mix or separately dispense the products.

In an alternative embodiment, the moveable wall could comprise a flexible lining or pouch located within the product chamber. In such an arrangement, the flexible lining or pouch could be disposed of once empty e.g. together with the outlet. In this embodiment too, a number of pouches or linings could be provided for dispensing e.g. in parallel by a single bellows arrangement. Within the context of flexible linings may also be included delaminating walls, releasing over-molded walls, inflated rubber walls and the like.

In certain embodiments of the invention, the bellows comprises a wall of the pressure chamber and an internal volume of the bellows is substantially contiguous to an interior of the pressure chamber. In this context, contiguous is intended to mean that the interior of the bellows and the pressure chamber effectively form a single volume or space with no effective pressure difference or flow resistance between them. This is to be distinguished from certain known devices where a bellows or pump may be used to pressurize a pressure chamber via a valve arrangement, allowing the pressure in the pressure chamber to be built up in a number of pumping actions. In the device according to the present invention, once the squeezing action on the bellows has been released, the pressure in the pressure chamber returns to atmospheric pressure or below, causing air to be sucked in via the air inlet.

In an alternative arrangement, the bellows is effectively separate from the pressure chamber and comprises a duct in fluid communication therewith. The duct may serve to mechanically engage the bellows with the pressure chamber and may comprise e.g. a nipple for forming the connection. As above, the duct is preferably in open communication with the pressure chamber i.e., without a valve therebetween.

As a result of the arrangement as presently proposed the device may comprises less than eight components, preferably less than six components and more preferably, less than five components. This refers to the in use condition, thus excluding a cap or other packaging. At its very simplest, the dispenser may comprise just three components, namely the housing including an unvalved outlet, the moveable wall and the bellows including an inlet valve. Such an arrangement is extremely simple to produce and may thus be relatively inexpensive.

The dispenser may be provided in various forms comprising different utility attachments for different purposes. The utility attachment may be a hair care attachment, a dental care attachment, a paste dispenser, a glue applicator, a mastic applicator, a stain removal tip, a skin care attachment, a dish washing attachment, a toilet brush, a viscous food applicator, a foaming or spraying head, a multiple nozzle head and a shaver head or any other attachment that may be required in combination with the dispensing of a fluid. The attachment may be integrally formed with the housing or attached e.g. releasably thereto. In this manner a single underlying design may be provided for use with different product contents according to the required use. Products that may be contained in the dispenser include hair care products, dental care products, adhesive products, mastic type DIY products, stain removing agents, skin care products, washing products including soaps and detergents, food products, toilet cleaning and other household products.

BRIEF DESCRIPTION OF THE DRAWINGS

The features and advantages of the invention will be appreciated upon reference to the following drawings, in which:

FIGS. 9 to 14 show further embodiments of the invention;

DESCRIPTION OF ILLUSTRATIVE EMBODIMENTS

Figure 1:
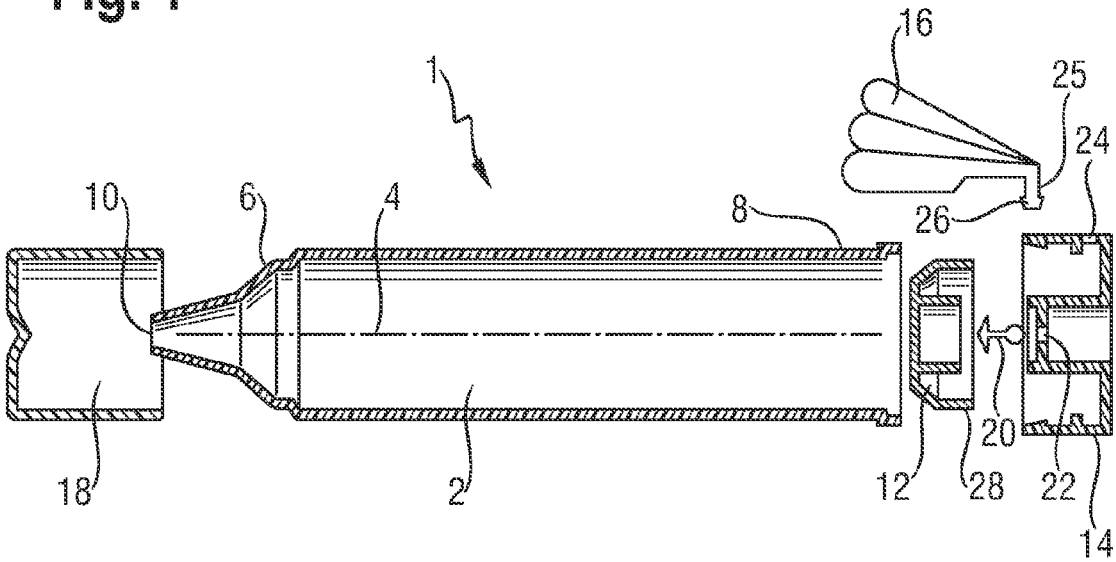
FIG. 1 is an exploded view of a dispenser according to a first embodiment of the invention.

The following is a description of certain embodiments of the invention, given by way of example only and with reference to the drawings. Referring to FIG. 1, there is shown a dispenser 1 according to a first embodiment of the invention in exploded view. The dispenser 1 comprises a tubular housing 2, a piston 12, a bottom cap 14, a bellows 16, a cover 18 and a one-way valve element 20. The housing 2 has a generally elongate axis 4 with a distal end 6 and a proximal end 8. An outlet 10 from an interior of the housing 2 is located at the distal end 6. Bottom cap 14 is generally cup shaped and has a centrally located inlet channel 22 and an opening 24 in its lateral wall. Bellows 16 is formed by blow-molding and has an outlet duct 25 terminating in a nipple 26. Piston 12 has a peripheral seal 28.

Figure 2:
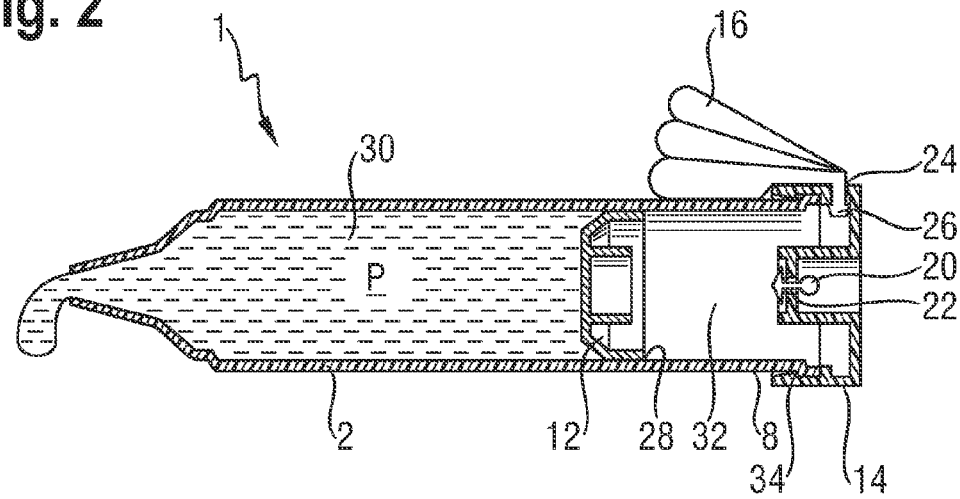
FIG. 2 is a sectional view of the embodiment of FIG. 1 in assembled state.

FIG. 2 shows the dispenser 1 of FIG. 1 in longitudinal section in its assembled condition with cover 18 removed. The piston 12 is located within the housing 2 with the peripheral seal 28 forming a sliding seal between the housing 2 and the piston 12. The piston 12 divides the housing 2 into a distal product chamber 30 and a proximal pressure chamber 32. A product P in the form of a cleaning gel is contained within the product chamber 30. The seal 28 prevents escape of the product in the direction of the pressure chamber 32. A rear wall of the pressure chamber 32 is provided by bottom cap 14 which engages with the proximal end 8 of the housing 2 by means of snap connector 34. Alternative engagement means may be envisaged as will be understood by the skilled person, including bayonet connection, other mechanical arrangements and permanent arrangements including gluing, welding, shrink fit, press fit and the like. One-way valve element 20 is engaged in inlet channel 22 to allow air flow through the inlet channel 22 towards the pressure chamber 32 but prevent air flow in the opposite direction. Nipple 26 is engaged in opening 24.

In use, a user grips the dispenser in the palm of his or her hand and exerts pressure on the bellows 16 using e.g. the fingers or thumb. The bellows 16 is compressed creating an increased pressure within the pressure chamber 32. In response to the increased pressure, one-way valve element 20 closes the inlet channel 22 preventing air from escaping by this route. The increased pressure is transmitted to the product P within the product chamber 30 by the piston 12. Since the cover 18 has been removed and the outlet 10 is open, product P can be dispensed. In doing so, the piston 12 slides within the housing 2 whereby the volume of the product chamber 30 is reduced. The housing 2 is formed in polypropylene and the piston 12 is made of polyethylene. As a result, the sliding friction of the piston 12 is low and the piston 12 will move until the pressure in the pressure chamber 32 once again corresponds substantially to atmospheric pressure. This will be the point at which the piston 12 has moved through a volume corresponding to the stroke volume of the bellows 16. It will also correspond to the volume of product dispensed. At this point, the bellows 16 is released. The resilience of its construction causes it to expand, thereby reducing the pressure in the pressure chamber 32. The one-way valve element 20 opens and air enters via the inlet channel 22. By choosing the valve element 20 to be of a quick opening-slow closing type, air may continue to pass until atmospheric pressure is once more achieved. The dispenser 1 is then ready for a following actuation.

The skilled person will of course understand that the pressure drop across the piston 12 can never be zero and that the air in the pressure chamber 32 will become compressed, leading to a slightly reduced delivery of product P. This delivered quantity will also decrease slightly as the product chamber 30 becomes empty and the pressure chamber 32 becomes larger. The same applies to the inlet valve 20 which will have a defined opening pressure. In order to achieve maximum uniformity from actuation to actuation over the dispensing of the product P, both pressure drops should be minimized.

Figure 3:
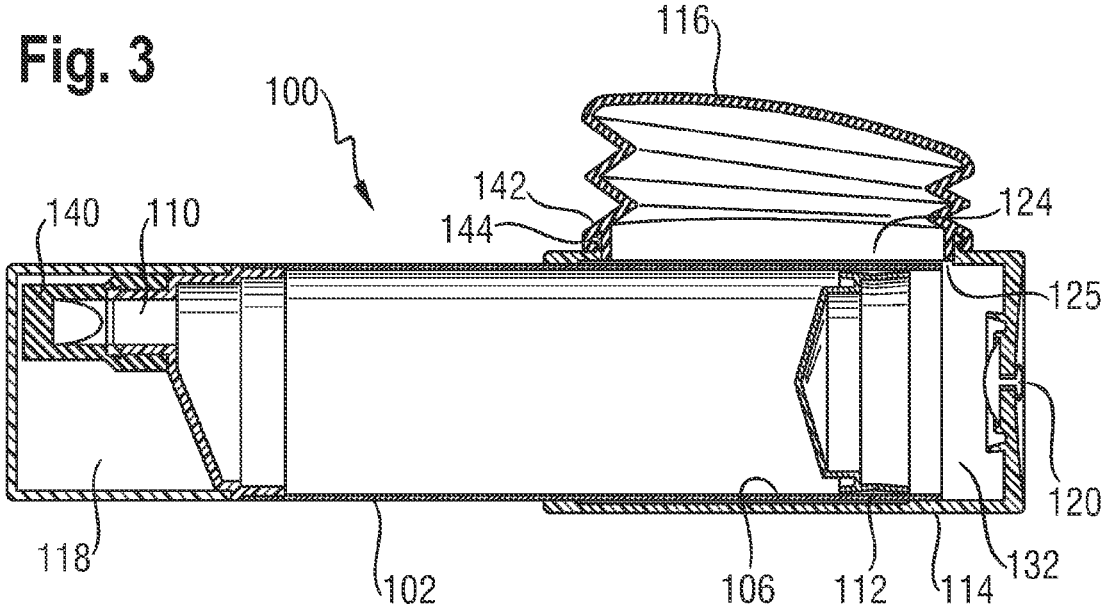
FIG. 3 is a sectional view of a second embodiment of the invention.

A dispenser 100 according to a second embodiment of the invention is shown in longitudinal cross-section in FIG. 3. Like elements to those of FIG. 1 are designated by the same numeral preceded by 100. According to FIG. 3, the dispenser 100 comprises a housing 102 in which slides piston 112. A bottom cap 114, bellows 116, cover 118 and a one-way valve element 120 are also provided. The dispenser 100 differs from the embodiment of FIG. 1 in that the bottom cap 114 is in the form of a sleeve that generally envelops the distal end 106 of the housing 102. Bottom cap 114 and housing 102 are connected by a bayonet connection (not shown). A further difference is the provision of an outlet check valve 140 extending from the outlet 110. The outlet check valve 140 is in the form of a soft duck-bill valve having a cracking pressure of 1 mbar. One example of such duck-bill valves is commercialized by Verna® Laboratories Inc. in fluorosilicon with the name VA3512. It is noted that the soft tip of the outlet check valve 140 is ideal for dispensing a line of product P. It also substantially prevents oozing or dripping of the product P once actuation has stopped.

The bellows 116 is of an oval concertina shape. It is made from TPE and has a large circumferential rim 142 that engages with a corresponding lip 144 around opening 124 on the bottom cap 114. A duct 125 communicates the interior of the bellows 116 with the pressure chamber 132. Operation of the dispenser 100 is the same as that of FIG. 1 and will not be further described in detail.

Referring to the dispenser execution shown in FIG. 3, the volume of the product P is 100 cc, the piston 112 outer diameter is 35 mm and the stroke is 110 mm. The device length is approximately 190 mm. The approximate maximum device span is 60 mm, which allow the user to conveniently hold the device without discomfort during the dispensing operation. The bottom cap 114 has an approximate length of 75 mm and diameter of 40 mm. Bellows 116 has an approximate volume of 25 ml and a nominal wall thickness of 1.2 mm. The length of the bellow on the primary/secondary axis is 60 mm and 40 mm respectively. The skilled person will understand that these represent approximate dimensions of a particular embodiment and that alternative embodiments having different dimensions may also be considered.

A version of the dispenser of FIG. 3 was used to dose a shear-thinning gel (viscosity of 120 Pa·s at 100 s−1 shear rate, power index 0.4). Initial actuation of the bellows with a firing speed of 960 mm/min. from resting to fully collapsed position resulted in a quantity of 20 ml (+/−10%) being dispensed. Three subsequent repetitions resulted in a gradual decreased quantity of gel being dispensed: the dose variance between the first and second dosing event was less than 10% and between the first and penultimate dosing events was less than 30%. Residue of product after the final actuation was less than 5% of the initial product volume.

Figure 17:
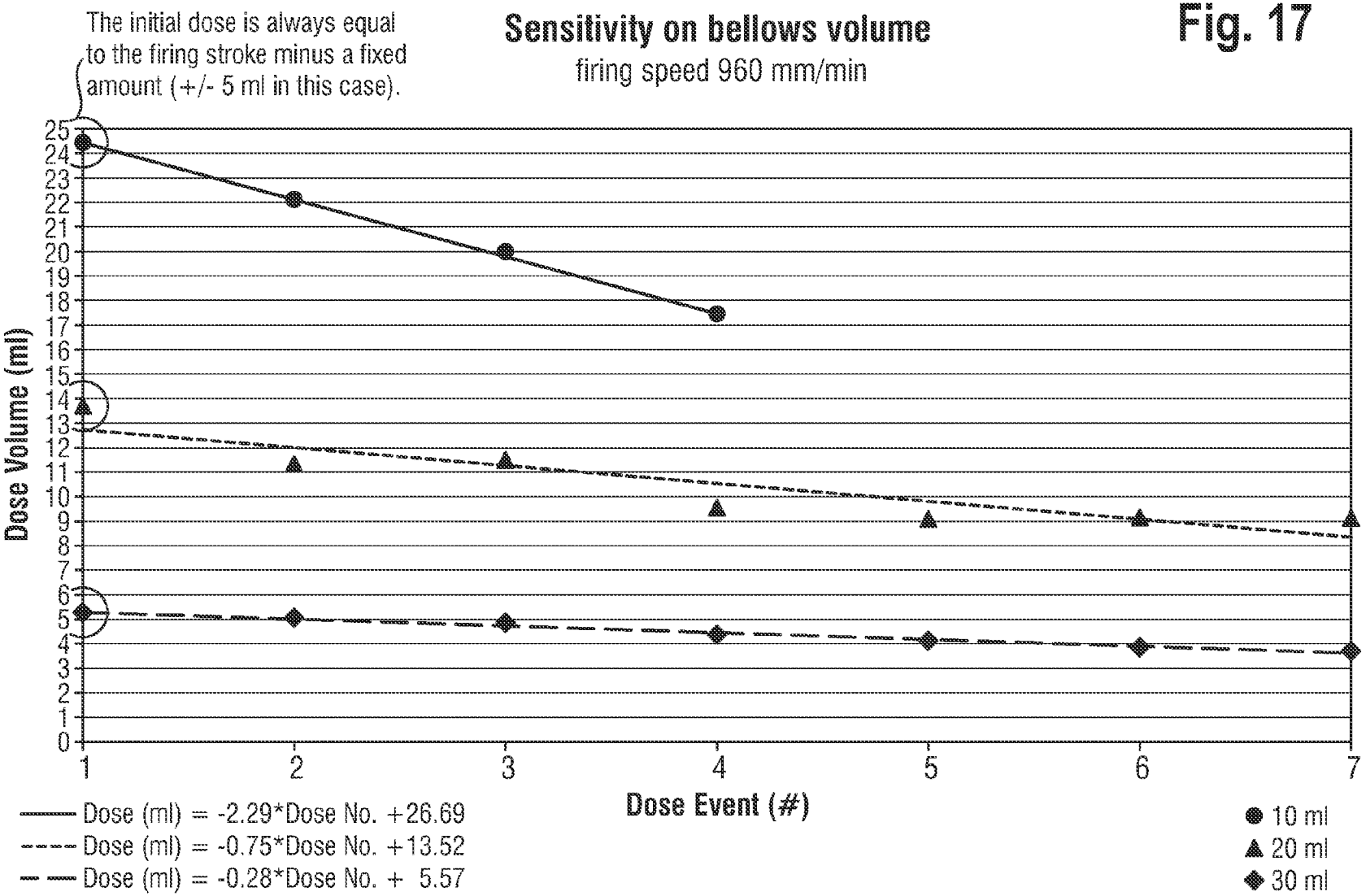
FIG. 17 shows a graphical representation of the dose variation with bellows size.

The same dispensing test was repeated with bellows of 10 ml, 20 ml and 30 ml in volume. Initial doses of 5 ml, 15 ml and 25 ml respectively (+/−10%) were measured. Subsequent repetitions still resulted in a small decrease in the dispensed dose: the dose variance between the first and second action was less than 10% and between the first and penultimate action was less than 30%. Residue of product after the final actuation was still less than 5% of the initial product volume. The results are graphically depicted in FIG. 17.

Figure 18:
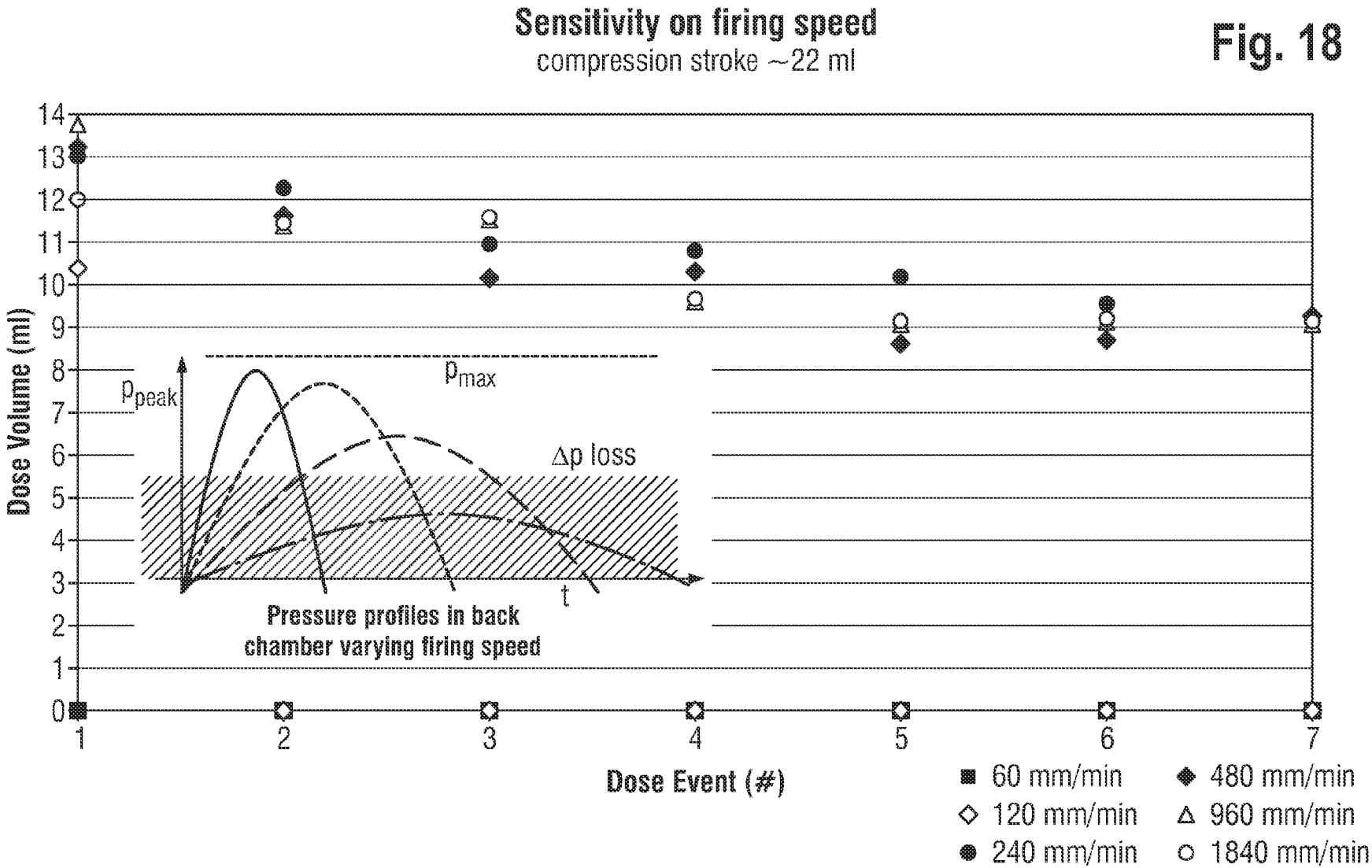
FIG. 18 shows a graphical representation of the dose variation with actuation speed.

Another version of the dispenser of FIG. 3 with a bellows of 20 ml in volume was used to test the sensitivity of the device to the firing speed. Actuation speeds below 240 mm/min resulted in a significant decrease of the dose being dispensed (or no product being dispensed at all). Above this speed, the dose corresponding to each subsequent dispensing repetition was consistent within +/−10%. Those skilled in the art will understand that for low values of the actuation speed or quasi-static actuation of the bellows, the inevitable air losses of the pressure chamber 132 off-set the pressure built-up in the bellows. The results are graphically depicted in FIG. 18. It will be understood that in practice dosing will not take place at a constant speed. Furthermore, although the minimum useful threshold speed recorded in the dispensing experiments was 240 mm/min, we may expect the device to work at even lower values of the firing speed by optimising device design and manufacturing tolerances.

Figure 4:
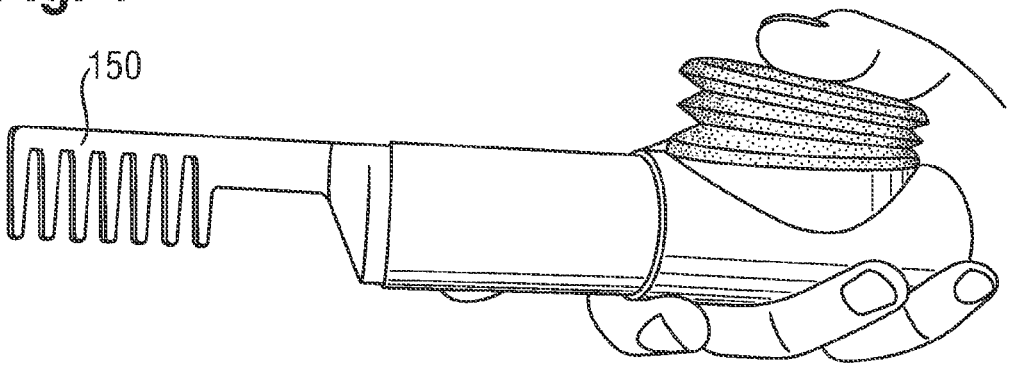
FIGS. 4 to 7 show different heads that may be applied to the dispenser of FIG. 3.
Figure 5:
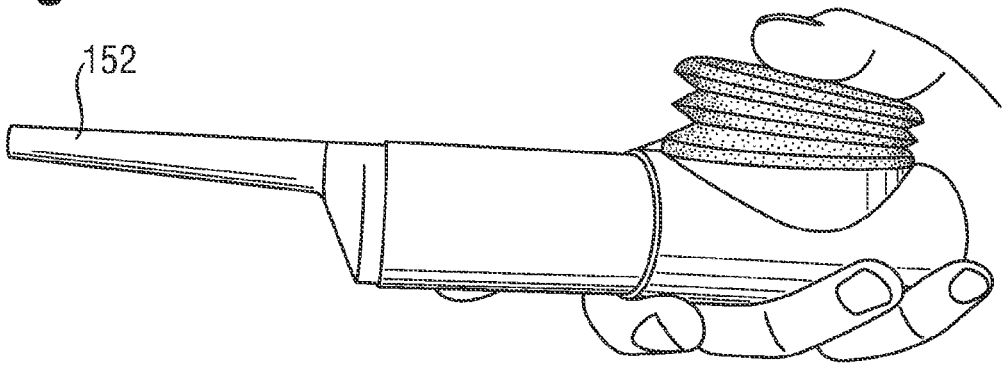
Figure 6:
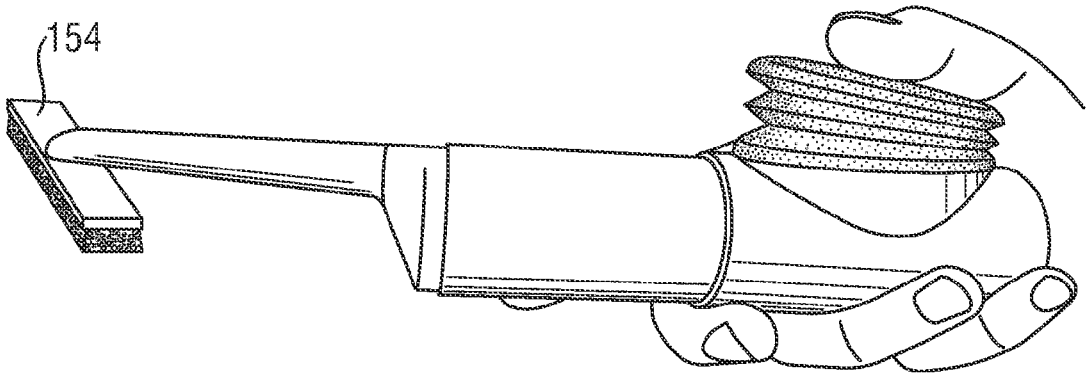
Figure 7:
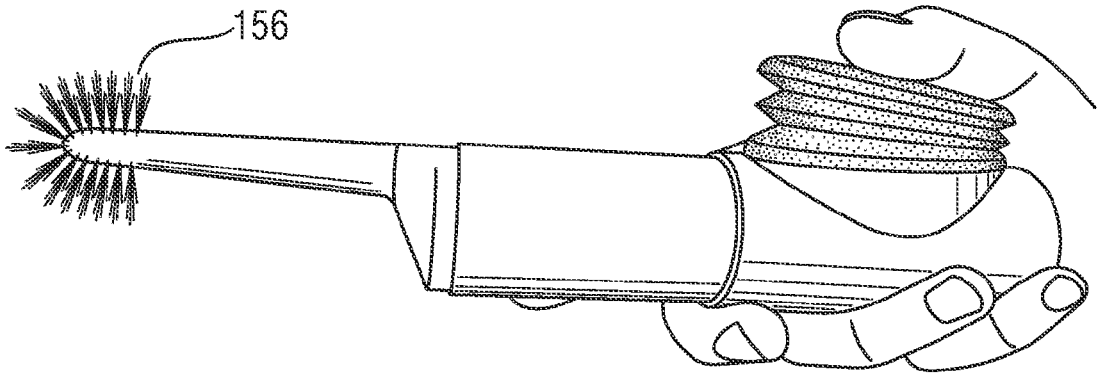

FIGS. 4 to 7 show different heads that may be applied to the dispenser 100 for different purposes. FIG. 4 incorporates a comb 150 instead of outlet check valve for dispensing hair care products. FIG. 5, includes an extended nozzle 152 for glue or mastic application. FIG. 6 includes a scrubber head 154 for skin care or for dish-washing purposes. FIG. 7 includes a toilet brush head 156 for application of gel while scrubbing a toilet bowl. Other examples are a viscous food applicator, a foaming or spraying head, a multiple nozzle head and a shaver head. The skilled person will be well aware of further alternative heads that may also be provided.

Figure 8:
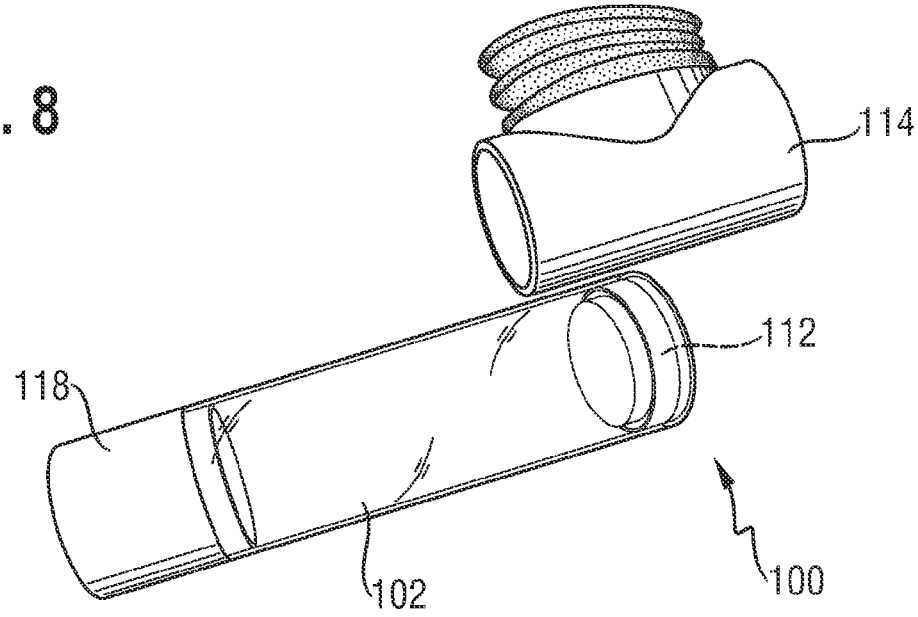
FIG. 8 shows the dispenser of FIG. 3 in disassembled state.

FIG. 8 shows the dispenser 100 in separated state with the housing 102 and bottom cap 114 separated. Both items may be separately manufactured and sold and the bottom cap 114 may be reusable with only the housing 102 disposed with the piston 112 once the product P is exhausted.

Figure 8A:
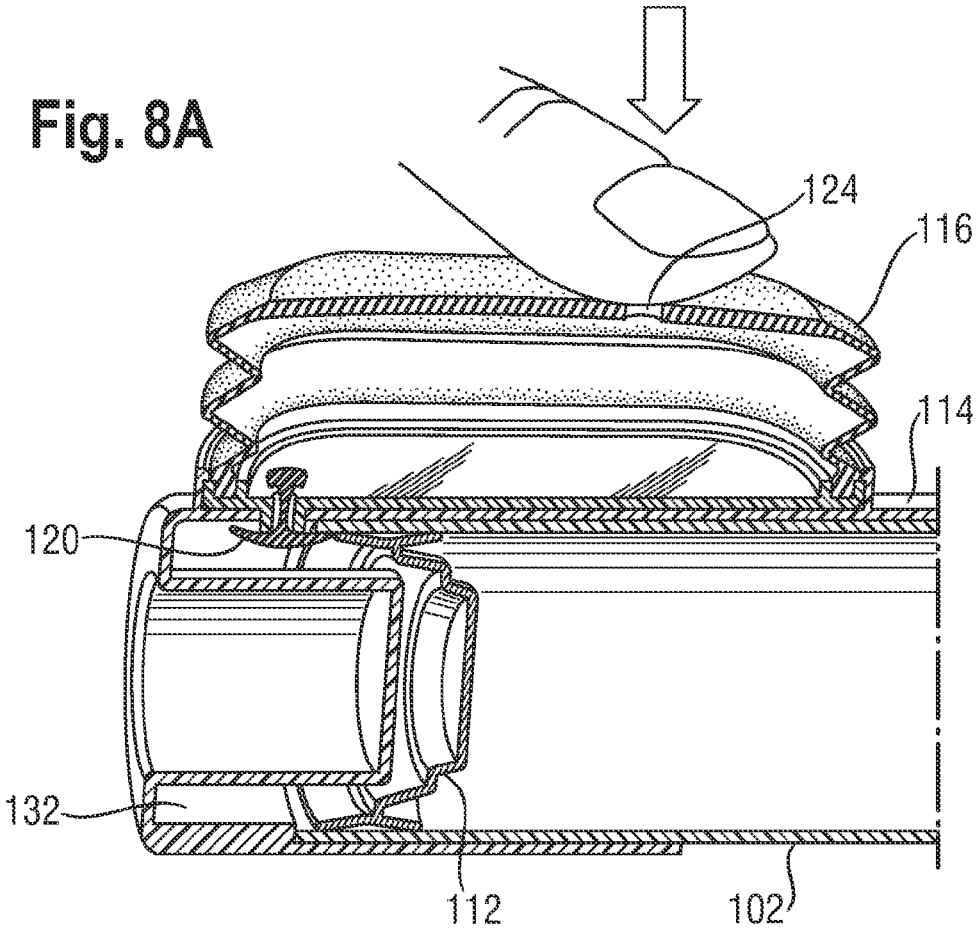
FIG. 8A shows a variation of the bottom cap of the second embodiment of the invention.
Figure 9:
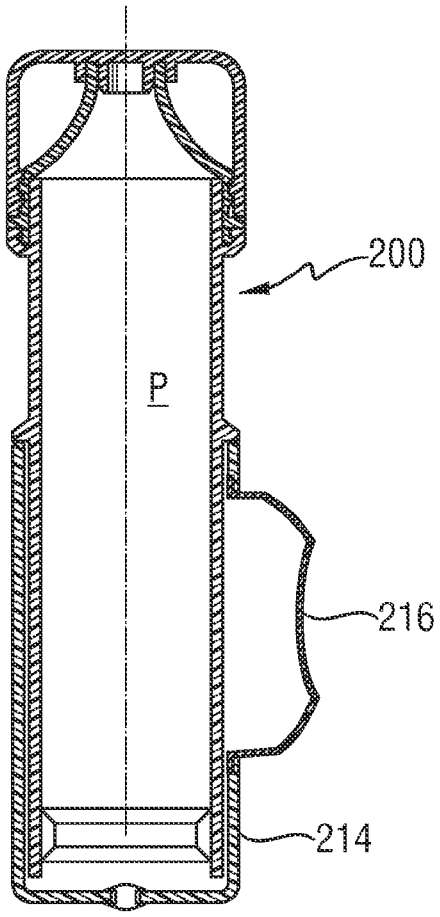

FIG. 8A shows a variation of the bottom cap 114 of the second embodiment of FIG. 8 in cross section. In this embodiment, the inlet for air to enter the bellows 116 is provided by an opening 124 directly into the interior of the bellows 116. This opening 124 may be covered by a user's finger or thumb on applying pressure to the bellows 116 and is open on removal of the finger, allowing refill of the bellows 116. Furthermore, one way valve element 120 is optionally arranged between the bellows 116 and pressure chamber 132. This allows pressure to be built up in the pressure chamber 132 by compressing the bellows 116, whereby the pressure will not subsequently be released on release of the bellows.

Figure 10:
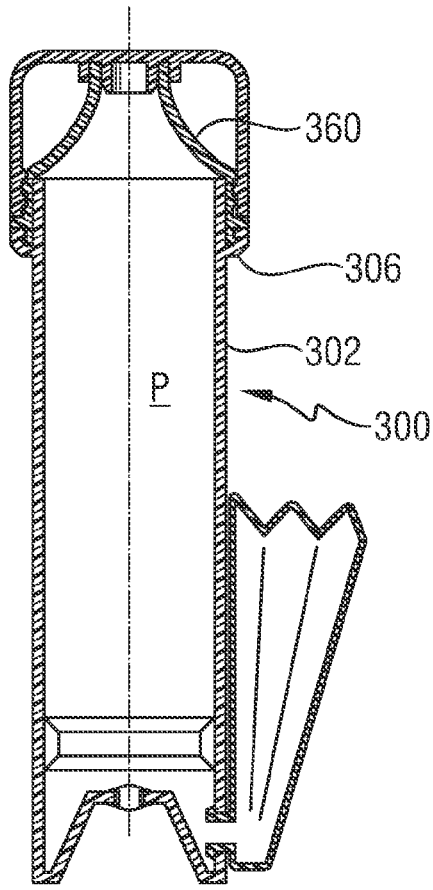
Figure 13A:
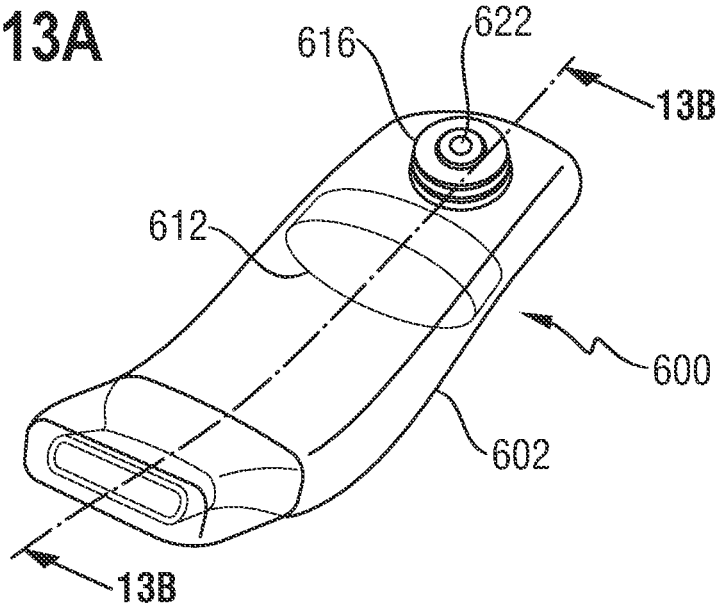
Figure 13B:
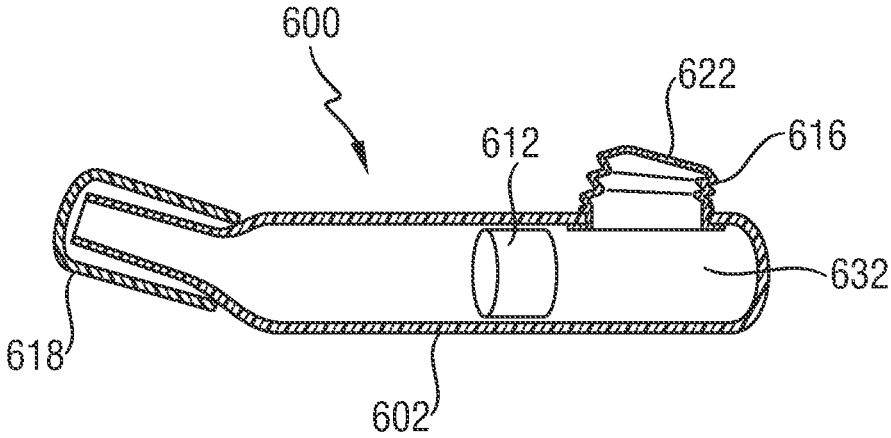

Further variations to the design are shown in FIGS. 9 to 14 in which like numerals denote corresponding features. Accordingly, in the dispenser 200 of FIG. 9, the bellows is replaced by a TPE dome 216 on one side of the bottom cap 214. In FIG. 10, the dispenser 300 has a housing 302 with a separate top cap 360 at its distal end 306 by which it may be filled with product P. In FIG. 11, the dispenser 400 is provided with an alternative bellows 416 arrangement aligned with the axis 404 and substantially contiguous to the pressure chamber 432. In the dispenser 500 of FIG. 12, the bellows 516 is located at a more distal location along the housing 502 and is connected to the pressure chamber 532 by a duct 525. The dispenser 600 of FIG. 13A is shown in cross section in FIG. 13B. It has a housing 602 of oval cross-section and has an oval piston 612. It also has a bellows 616 contiguous to the pressure chamber 632. According to an important aspect of dispenser 600, no one-way inlet valve is provided. Instead, the bellows 616 includes an inlet channel 622 located such that a user's thumb or finger obstructs the channel 622 during the actuation of the bellows 616. On releasing actuation of the bellows 616, the channel 622 is freed and air may enter the bellows 616 and the pressure chamber 632.

In the embodiment of FIG. 14, the dispenser 700 comprises a housing 702 including a threaded closure 762. The bellows 716 attaches to the threaded closure 762 and is contiguous to the pressure chamber 732. A one-way valve 720 is formed by a flexible ring located within the threaded closure 762.

Figures 15A, 15B, 15C:
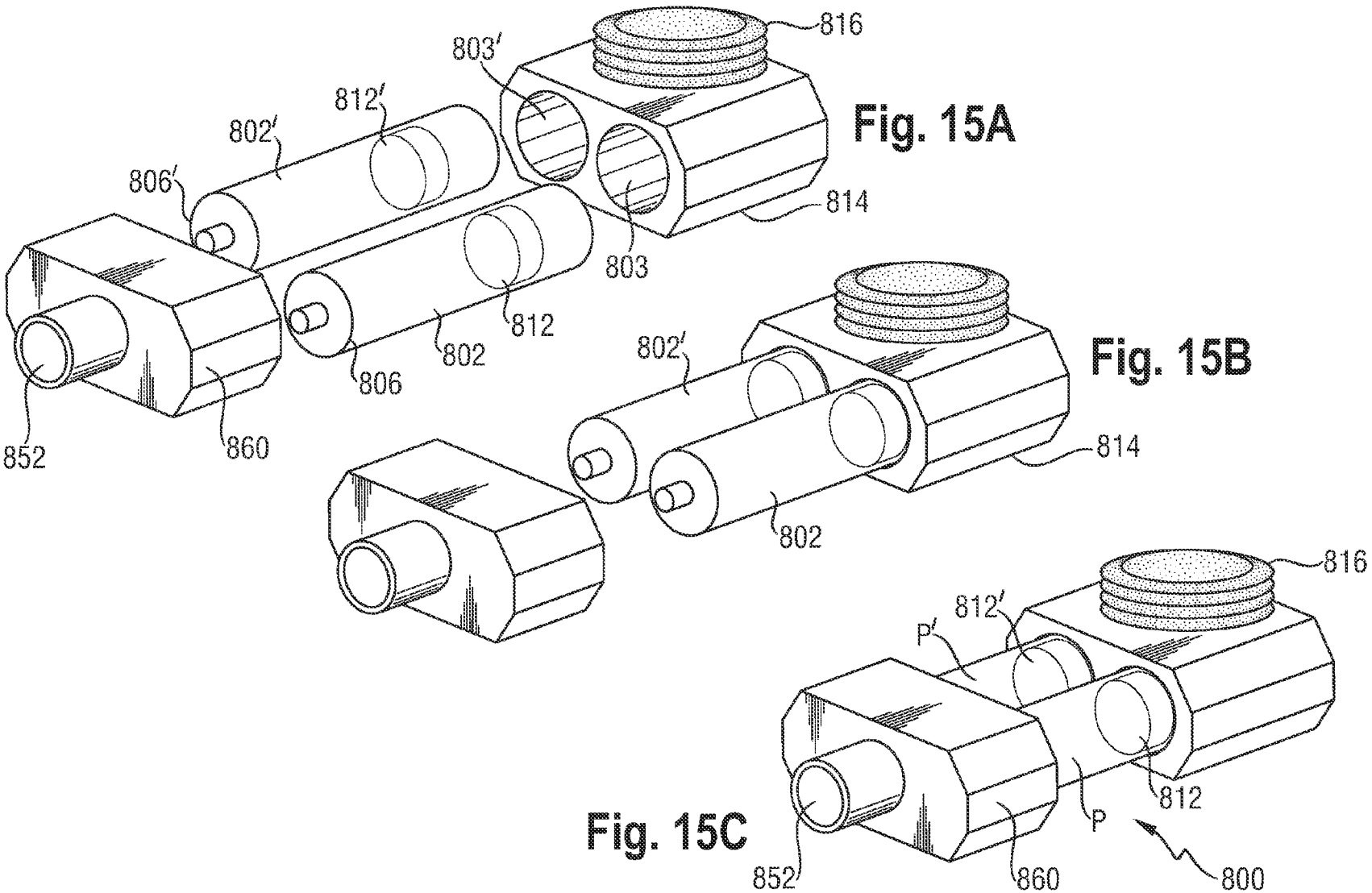
FIGS. 15A, B and C show an embodiment of the invention for dual product dispensing.

In a further embodiment of FIGS. 15A, B and C, a dispenser 800 for dual dispensing is shown in disassembled, partially assembled and assembled views. Like elements to those of FIG. 1 are designated by the same numeral preceded by 800. According to FIG. 15A, the dispenser 800 comprises a pair of housings 802, 802' in which slide pistons 812, 812'. A bottom cap 814 has a pair of bores 803, 803' to receive the housings 802, 802', and a single bellows 816. It will however be understood by the skilled person that a pair of separate bellows could also be provided on the bottom cap 814. A one-way valve element (not shown) is also provided on the bottom cap 814. A top cap 860 is provided distally of the dispenser 800 for connection to the distal ends 806, 806' of the housings 802, 802'. Top cap acts as a mixing head and is provided with an outlet nozzle 852 in which may be located an outlet check valve (not shown). It will also be understood that separate nozzles may be provided for each housing 802, 802' especially when used in combination with a bottom cap having separate bellows.

In FIG. 15 B the housings 802, 802' have been assembled to the bottom cap 814 and in FIG. 15 C the top cap 860 has been assembled and the dispenser 800 is filled with product P, P' and ready for use. In operation, the dispenser 800 is used in the same manner as that of FIG. 1. On actuating the bellows 816 however, equal pressure is applied to both of the pistons 812, 812' and products P, P' are dispensed from both of the housings 802, 802' to the top cap 860 where they are mixed on exit from the nozzle 852. It will be understood that by providing different diameters for the two housing 802, 802' different relative quantities of the products may be dispensed. Alternatively, if the product viscosities are different, different diameters may be needed in order to achieve equal dispensing. More than two housings may also be provided for dispensing multiple products.

Figure 16A:
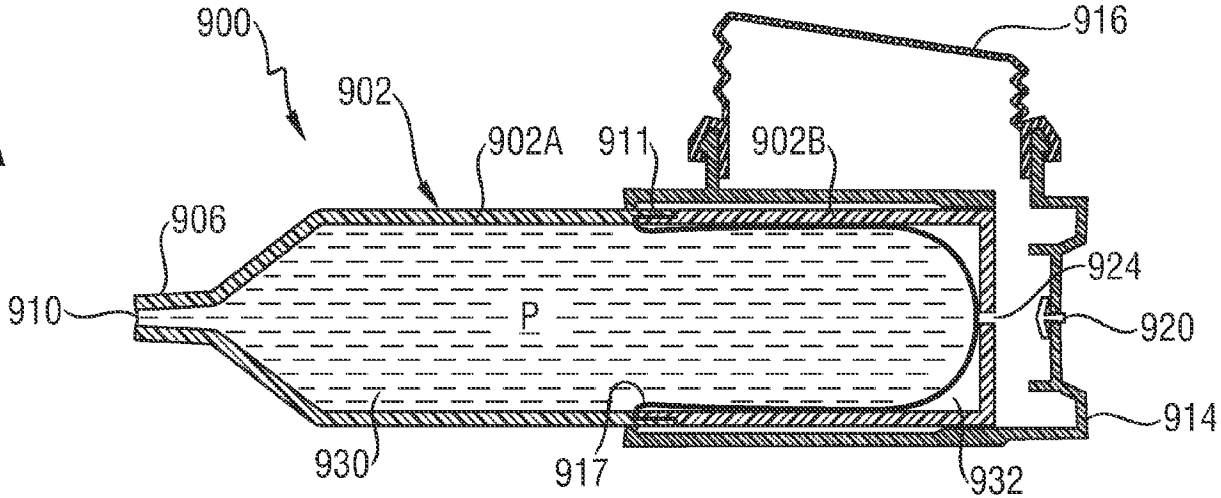
FIGS. 16 A and B show an embodiment of the invention using a flexible liner.
Figure 16B:
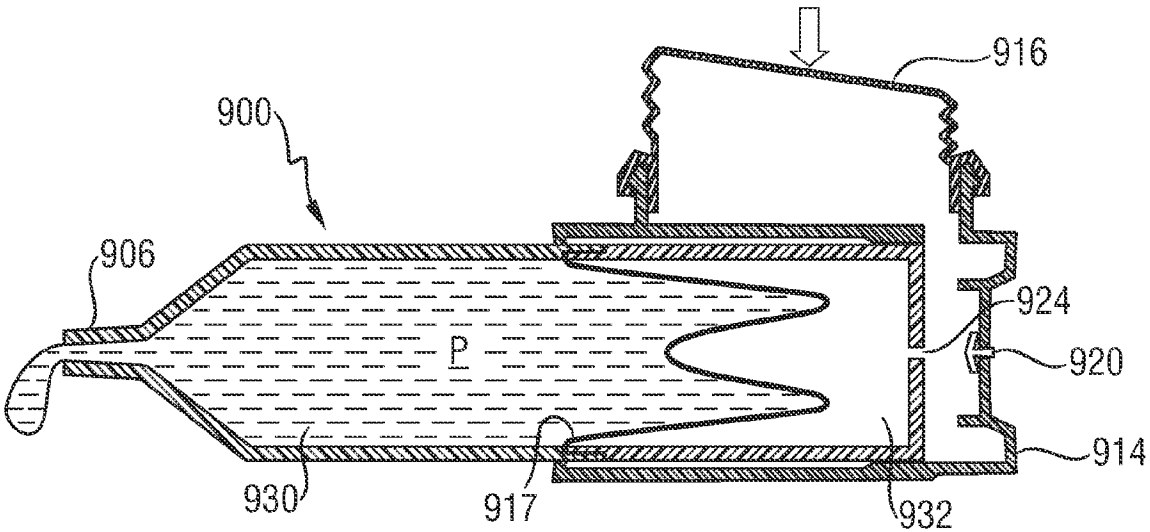

In a still further embodiment according to FIGS. 16A and 16B a dispenser 900 is shown. According to FIG. 16A, the dispenser 900 comprises a housing 902. Unlike earlier embodiments, the housing is formed in two parts 902A, 902B which are joined at a weld 911. Between the two parts 902A, 902B is held a liner 917 which replaces the piston of earlier embodiments and which acts as a moveable wall. Product P is held in the product chamber 930 delimited by the housing part 902A and the liner 917. The region delimited by the housing part 902B and the liner 917 forms the pressure chamber 932. A bottom cap 914 is provided with a bellows 916 and a one-way valve element 920. The bottom cap 914 is in the form of a sleeve that generally envelops the housing part 902B. Bottom cap 914 and housing part 902B are connected by a bayonet connection (not shown). An opening 924 in the base of housing part 902B communicates the pressure chamber 932 with an interior of the bottom cap 914. The distal end 906 has an outlet 910 and may be provided with an outlet check valve as in earlier embodiments if required.

Operation of the dispenser 900 is shown in relation to FIG. 16B and is generally the same as that of earlier embodiments. Actuation of the bellows 916 causes an increase in pressure within the bottom cap 914. The pressure is transmitted via opening 924 to the pressure chamber 932 and via the flexible liner 917 to the product chamber 930. The product P is forced out of the distal end 906 via outlet 910. As product is dispensed, the liner 917 moves towards the distal end 906 until it assumes a position close to the inside surface of the housing part 902A. At this point, substantially all of the product P will have been dispensed. Due to the flexibility of the liner 917, little pressure drop is experienced across it. The housing 902 may be filled through its distal end 906 or prior to joining the parts 902A, 902B and the liner 917.

Thus, the invention has been described by reference to certain embodiments discussed above. It will be recognized that these embodiments are susceptible to various modifications and alternative forms well known to those of skill in the art without departing from the spirit and scope of the invention. Accordingly, although specific embodiments have been described, these are examples only and are not limiting upon the scope of the invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A dispenser for viscous products, comprising:

a housing having a generally elongate axis with a distal end, a proximal end and an interior volume;

a moveable wall dividing the interior volume of the housing into a distal product chamber and a proximal pressure chamber in pressure communicating relation with one another;

an outlet from the product chamber adjacent to the distal end;

an inlet to the pressure chamber having a one-way arrangement allowing air to enter the pressure chamber when the pressure of the chamber is lower than atmospheric pressure; and a bellows, in fluid communication with the pressure chamber, that on actuation can be reduced in volume and that can subsequently recover, the bellows assembly being arranged for actuation by lateral pressure exerted generally perpendicular to the housing axis, wherein the inlet does not allow air to escape during compression of the bellows.

2. The dispenser of claim 1, wherein the outlet is provided with a check-valve.

3. The dispenser of claim 1, wherein the housing comprises two sections, a reservoir section comprising the product chamber and a driver section carrying the bellows assembly and at least partially comprising the pressure chamber.

4. The dispenser according to claim 3, wherein the reservoir section is disposable and the driver section is reusable.

5. The dispenser of claim 1, wherein the bellows is located adjacent the proximal end of the housing.

6. The dispenser of claim 1, wherein the housing comprises a cylinder and the moveable wall comprises a piston, axially slideable within the cylinder.

7. The dispenser according to claim 6, comprising a plurality of cylinders and a plurality of pistons, each axially slideable within its respective cylinder and wherein the bellows applies substantially equal pressure to a pressure chamber of each cylinder.

8. The dispenser of claim 1, wherein the moveable wall comprises a flexible lining or pouch.

9. The dispenser of claim 1, wherein the bellows comprises a relatively deformable elastomeric material and the pressure chamber comprises a relatively rigid material.

10. The dispenser of claim 1, wherein the bellows comprises a wall of the pressure chamber and an internal volume of the bellows is substantially contiguous to an interior of the pressure chamber.

11. The dispenser of claim 1, wherein the bellows comprises a duct in fluid communication with the pressure chamber.

12. The dispenser according to claim 11, wherein the outlet passage is mechanically engageable to connect the bellows with the pressure chamber.

13. The dispenser of claim 1, wherein in use, the device comprises less than eight components, preferably less than six components and more preferably, less than five components.

14. The dispenser of claim 1, further comprising a utility attachment, wherein the utility attachment is selected from the group consisting of: a hair care attachment, a dental care attachment, a paste dispenser, a glue applicator, a mastic applicator, a stain removal tip, a skin care attachment, a dish washing attachment a toilet brush, a viscous food applicator, a foaming or spraying head, a multiple nozzle head and a shaver head.

* * * * *